United States Patent [19]

Yuki

[11] Patent Number: 5,068,950

[45] Date of Patent: Dec. 3, 1991

[54] PROVISIONAL PULL TAB FOR SLIDE FASTENER SLIDERS

[75] Inventor: Kenji Yuki, Toyama, Japan

[73] Assignee: Yoshida Kogyo K. K., Tokyo, Japan

[21] Appl. No.: 507,032

[22] Filed: Mar. 30, 1990

[30] Foreign Application Priority Data

Mar. 31, 1989 [JP] Japan ..... 1-83820

[51] Int. Cl.[5] ..... A44B 19/30

[52] U.S. Cl. ..... 24/429; 24/419

[58] Field of Search ..... 24/429, 419, 421, 30.5 P, 24/30.5 S

[56] References Cited

U.S. PATENT DOCUMENTS

| | | | |
|---|---|---|---|
| 2,280,999 | 4/1942 | Carlile . | |
| 2,290,834 | 7/1942 | Kohler | 24/419 |
| 2,535,505 | 12/1950 | Morin | 24/419 |
| 2,865,075 | 12/1958 | Firing et al. | 24/419 |
| 2,880,489 | 4/1959 | Burbank | 24/419 |
| 3,641,634 | 2/1972 | Asai | 24/429 |
| 4,470,173 | 9/1984 | Adamson | 24/30.5 P |
| 4,509,231 | 4/1985 | Paxton | 24/30.5 S |
| 4,624,032 | 11/1986 | Ishii et al. | 24/419 |
| 4,790,050 | 12/1988 | Ishii | 24/419 |

FOREIGN PATENT DOCUMENTS

| | | |
|---|---|---|
| 0090370 | 10/1983 | European Pat. Off. . |
| 1201522 | 8/1970 | United Kingdom . |
| 2190706 | 11/1987 | United Kingdom . |

*Primary Examiner*—Victor N. Sakran

*Attorney, Agent, or Firm*—Hill, Van Santen, Steadman & Simpson

[57] ABSTRACT

In a slider for slide fasteners including a slider body having an lug on its upper surface; a provisional pull tab is releasably mounted on the slider body during a finishing process and inspection. The provisional pull tab comprises a grip portion adapted for being gripped and pulled for manipulation of the slider; a surrounding attachment rim integrally extending from the grip portion and defining with a proximal end of the grip portion an aperture, through which the attaching lug is inserted so that the provisional pull tab is pivotally mounted on the lug; and a fragile portion disposed around the aperture so that the provisional pull tab can be removed from the lug with great ease.

8 Claims, 7 Drawing Sheets

PROVISIONAL PULL TAB FOR SLIDE FASTENER SLIDERS

BACKGROUND OF THE INVENTION

1. Field of the Invention:

The present invention relates generally to a slider for a slide fastener and more particularly to a provisional pull tab attached to the slider provisionally when the slider is subjected to stringer-threading step or when it is manipulated to inspect the performance of reciprocating along fastener element rows.

2. Description of the Prior Art:

Nowadays, a pull tab of a slide fastener slider has been playing an increasingly important role in enhancing fashionableness and attracting eyes, so that various types of pull tabs are manufactured so as to suit various specific tastes of consumers. In order to satisfy such consumers' demand to attach to sliders such various pull tabs as suit their individual tastes, sliders of the construction capable of having pull tabs releasably attached thereto have been developed. One typical example of such sliders of the non-locking type is disclosed in U.S. Pat. No. 4,780,938 and another example but of the automatic-locking type is disclosed in U.S. Pat. No. 4,893,638.

In a process of finishing a slide fastener, there is what we commonly call "stringer-threading step"; that is, a step of threading a pair of right and left stringers of the slide fastener into a Y-shaped channel of a slider in order to slidably mount the slider on the slide fastener. As reillustrated herein in FIG. 8; in this step, the non-locking type slider 11 is first mounted upside down in a recess 125 in a top of a slider holder 101 with its pull tab 107 depending downward therefrom by its own gravity; then, a locking lever 103 is swinged clockwise (as viewed in FIG. 8) so as to bring a detent 104 into fitting engagement with an aperture 112 of the depending pull tab 107, thus pulling the slider 11 downwardly into stably resting in the recess 102 and then the pair of right and left fastener stringers (not shown) are threaded through the Y-shaped channel 14 of the slider 11. As far as an automatic-locking slider 50 is concerned, in addition to the function of causing the slider 50 to stably rest in the recess 102; as shown in FIG. 9, pull of the pull tab 107 by the detent 104 has another function of pulling a locking member 57 of the slider 50 downwardly, thus bringing the locking prong 59 out of the Y-shaped channel 53 so as to permit a pair of fastener stringers (neither shown) to be threaded through the Y-shaped channel 53 of the slider 50 at rest. A pull tab 107 is thus indispensable in the finishing process for both types of sliders 11, 50. Furthermore, in an inspection following the finishing process, a pull tab 107 is also necessary to pull a slider 11, 50 back and forth so as to see whether the slider 11, 50 accomplishes proper function of reciprocating along the fastener stringers. For these reasons, even during the finishing process and inspection, a commercial pull tab 107 or a pull tab suitable to commerce heretofore must be attached to the slider 11, 50.

However, it is acknowledged that the operation of detaching the pull tab 107 from the slider 11, 50 is much more difficult and tedious than that of attaching the pull tab 107 to the slider 11, 50. Furthermore, during the stringer-threading step, particularly if an aperture 112 in the pull tab 107 is too small, the detent 104 is very difficult to fit into such a small aperture 112, thus being liable to damage the pull tab 107 around the aperture 112, thereby adversely affecting the commercial quality of the pull tab 107.

SUMMARY OF THE INVENTION

With the foregoing difficulties in view, it is therefore an object of the present invention to provide a provisional pull tab which can be attached to a slider provisionally for the finishing process and inspection and, after having been used therefor, detached from the slider extremely easily and swiftly to permit a variety of commercial pull tabs to be attached so as to suit consumers' individual tastes and variable fashions.

According to the present invention, there is provided; in a slider for slide fasteners including a slider body having a lug on its upper surface; a provisional pull tab releasably mounted on the slider body and comprising a grip portion adapted for being gripped and pulled for manipulation of the slider; a surrounding rim integrally extending from the grip portion and defining with a proximal end of the grip portion an aperture, through which the lug is inserted so that the provisional pull tab is pivotally mounted on the lug; and a fragile portion disposed around the aperture.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
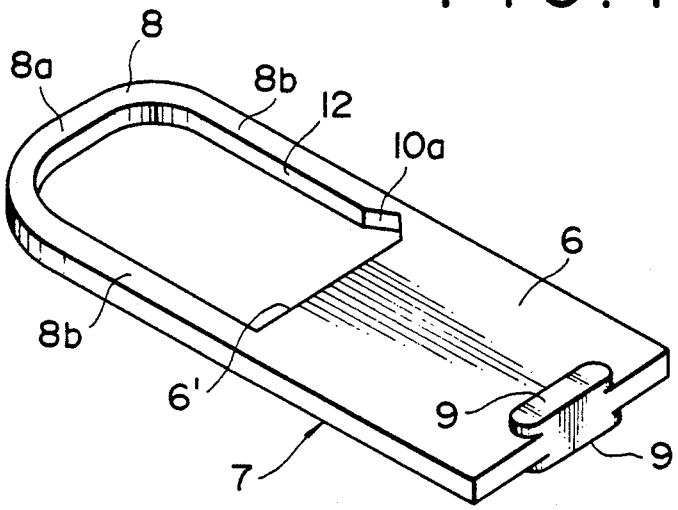
FIG. 1 is a perspective view of a provisional pull tab according to the first embodiment of the present invention.

FIG. 1 shows a provisional and disposable pull tab 7 according to the present invention. The provisional pull tab 7 is of substantially rectangular, flat and thinned construction and made of unexpensive materials such as plastics and metals. The provisional pull tab 7 comprises a grip portion 6 to be gripped and pulled by fingers for manipulation of the slider 11, 50 and a surrounding rim 8 integrally extending from the grip portion 6. The grip portion 6 is of substantially rectangular, flat and thinned plate-like construction. The surrounding rim 8 is also substantially rectangular and comprises a pair of side rods 8*b*, 8*b* and a spindle 8*a* joining the distal ends of the side rods 8*b*, 8*b*, to thus define with the proximal edge 6′ of the grip portion 6 a substantially rectangular aperture 12. Importantly, a triangular notch 10*a* is formed in one of the side rods 8*b*, 8*b* at its proximal end so as to communicate with the rectangular aperture 12, the triangular notch 10*a* constituting a fragile portion. Reference numerals 9, 9 denote a pair of projections, one mounted on either surface of the grip portion 6 on its distal end, the projections 9, 9 being adapted for preventing fingers from slipping out of the grip portion 6 during the manipulation of the provisional pull tab 7.

Figure 2:
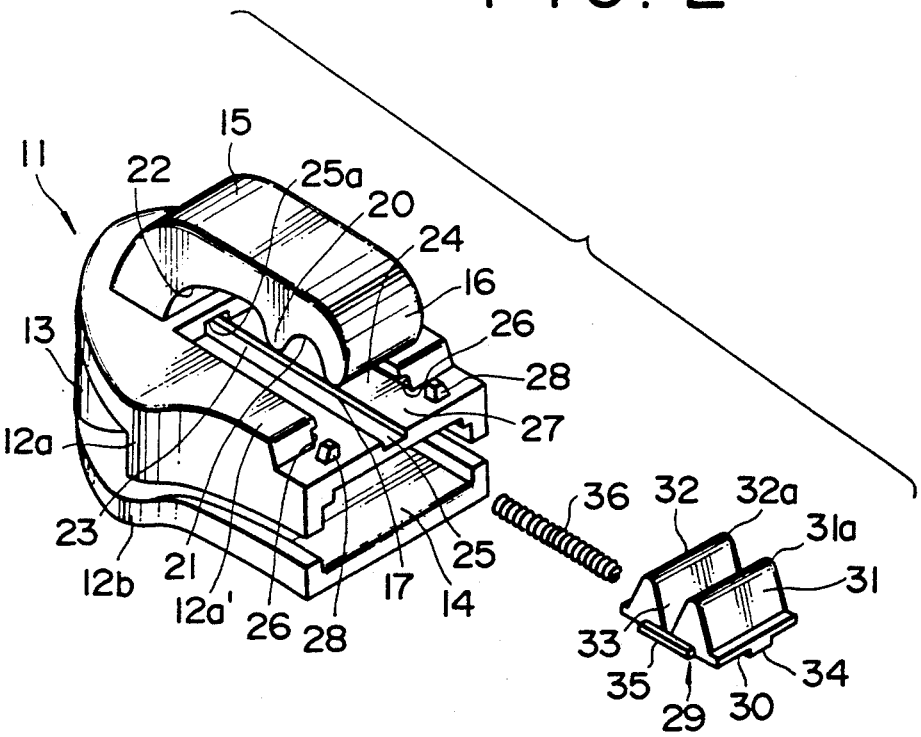
FIG. 2 an exploded perspective view of a non-locking type slider to which the provisional pull tab according to the present invention is to be attached.
Figure 3:
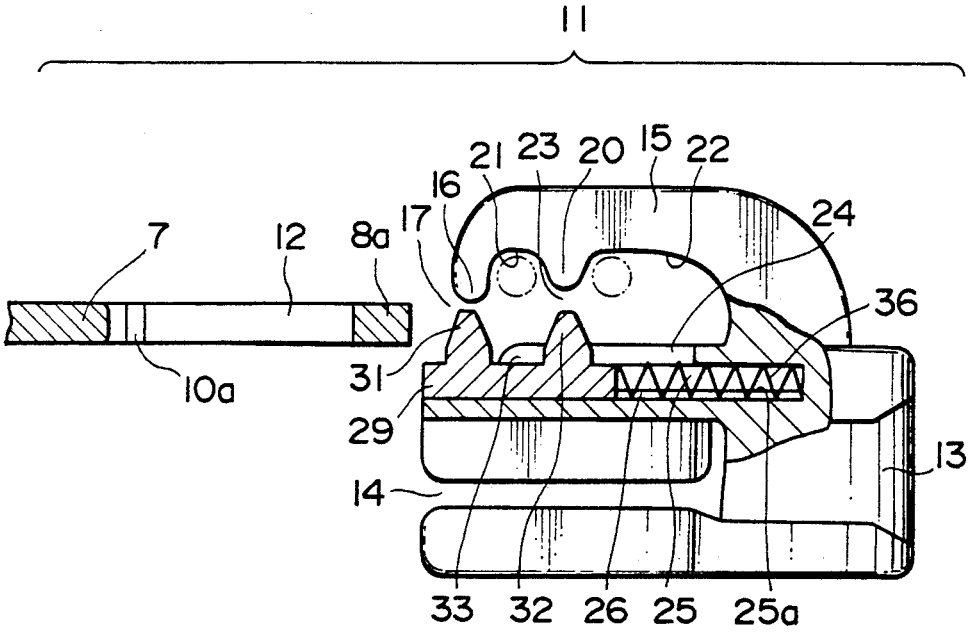
FIG. 3 is a longitudinal cross-sectional view of the non-locking type slider of FIG. 2, showing the provisional pull tab disposed immediately before being attached to the slider.

One typical example of a non-locking type slider 11 to which the provisional pull tab 7 is applied will be briefly described hereinbelow in conjunction with FIGS. 2 and 3. The slider 11 includes a slider body having a pair of upper and lower wings 12*a*, 12*b* joined at their front ends by a neck 13 so as to define therebetween a generally Y-shaped guide channel 14 for the passage therethrough of a pair of opposed rows of coupling elements of a slide fastener (not shown). The slider body has an arch-shaped lug 15 integral therewith and disposed on the top surface 12*a*′ of the upper wing 12*a*. The arch-shaped lug 15 extends from the front end of the upper wing 12*a* and terminates in a downwardly directed rear free end 16 spaced from the top surface 12*a*′ of the upper wing 12*a* by a predetermined gap 17 larger than the diameter of the spindle 8*a* of the provisional pull tab 7. The arch-shaped lug 15 has on its underside an intermediate partition wall 20 disposed between the front and rear ends of the lug 15 and extending transversely across the width of the lug 15 so that there are two adjacent, downwardly open recesses 21, 22 defined on opposite sides of the partition wall 20. The partition wall 20 is spaced from the top surface 12*a*′ of the upper wall 12*a* by a gap 23 which is greater than the diameter of the spindle 8*a* of the provisional pull tab 7. The first recess 21 disposed adjacent to the rear free end 16 serves to temporarily receive the spindle 8*a* of the pull tab 7 before the spindle 8*a* is finally received in the second recess 22 disposed adjacent to the front end of the lug 15.

The slider body has a recessed portion 24 extending longitudinally in the top surface 12*a*′ of the upper wing 12*a* from rear end and terminating short of the fixed front end of the lug 15. The recessed portion 24 has a central guide groove 25 formed in the bottom wall of the recessed portion 24 and extending in a longitudinal central axis of the slider body, and a pair of lateral guide grooves 26, 26 extending in and along the opposite side walls of the recessed portion 24. The central guide groove 25 has an end extension 25*a* extending in the upper wing 12*a* below the front end of the lug 15 and terminating short of the front end of the upper wing 12*a*.

The top surface 12*a*′ of the upper wing 12*a* has a cutout 27 extending transversely along the rear end of the upper wing 12*a* and lying flush with the bottom surface of the recessed portion 24, and a pair of laterally spaced stopper projections 28, 28 disposed on the cutout 27 adjacent to the rear end of the upper wing 12*a*. The stopper projections 28 are slightly displaced laterally outwardly from the lateral guide grooves 25.

The slider body further includes a closure member 29 slidably mounted in the recessed portion 24. The closure member 29 includes a rectangular base 30 slidably received in the recessed portion 24, and a pair of parallel spaced closure projections 31, 32 integral with the base 30 and extending transversely of the longitudinal axis of the slider body. The closure projections 31, 32 are tapered and define therebetween an upwardly flared triangular recess 33. The tapered closure projections 31, 32 have respective top edges 31*a*, 32*a* spaced from one another by a distance which is equal to the distance between the rear free end 16 of the lug 15 and the partition wall 20. The closure member 29 further has a central guide ridge 34 extending longitudinally on the underside of the base 30 and slidably fitted in the central guide groove 25 in the upper wing 12*a*, and a pair of lateral guide ridges 35 (only one shown in FIG. 1) extending on the opposite side surfaces of the base 30 and slidably fitted in the lateral guide grooves 26 in the upper wing 12*a*. A resilient member comprising a compression coil spring 36 is disposed in the central guide groove 25 with part received in the end extension 25*a*. The spring 36 acts between the slider body and the closure member 29 to normally urge the closure member 29 toward the rear end of the slider body. The rearward movement of the closure member 29 is restricted by a pair of stops engaging the rear ends of the respective lateral guide ridges 35 of the closure member 29.

Assemblage of the non-locking type slider 11 of the construction set forth above will be effected as described hereinbelow. The stopper projections 28 are initially displaced laterally outwardly out of alignment with the lateral guide groove 26 in the upper wing 12*a*. After the spring 36 and the closure member 29 have been inserted in the recessed portion 24, the stopper projections 28 are deformed or bent laterally inwardly into paths of movement of the lateral guide ridges 35 to thereby provide the respective stops. In this instance, the closure member 29 is held in a closed position (FIG. 2) in which the closure projection 31, 32 are disposed in vertical alignment with the rear free end 16 of the lug 15 and the partition wall 20, respectively, with slight spaces therebetween. Subsequently, the closure member 29 is moved from its closed position to its open position (not shown) against the bias of the spring 36 by simply pushing the closure projection 31 by the spindle 8*a* of the provisional pull tab 7 until the closure projection 31 is brought into vertical alignment with the partition wall 20. The spindle 8*a* of the provisional pull tab 7 has now been threaded through the gap 17 into the first recess 21 in the lug 15, whereupon the closure member 29 returns to its closed position (FIG. 2) under the force of the spring 36 in which position the spindle 8*a* of the provisional pull tab 7 is temporarily received in a space formed jointly by the first recess 21 in the lug 15 and the recess 33 in the closure member 29. Thereafter, the pull tab 7 is pushed again to displace the closure projection 32 forwardly against the bias of the spring 36 until the gap 23 is opened, whereupon the spindle 8*a* enters the second recess 22 in the lug 15. Thus, the provisional pull tab 7 is threaded on the lug 15 with its spindle 8*a* received in the second recess 22. The closure member 29 is returned again to its closed position in which the closure projection 32 is disposed in vertical alignment with the partition wall 20, so that the provisional pull tab 7 is now firmly retained on the slider body against accidental removal during the finishing process and inspection.

Figure 4:
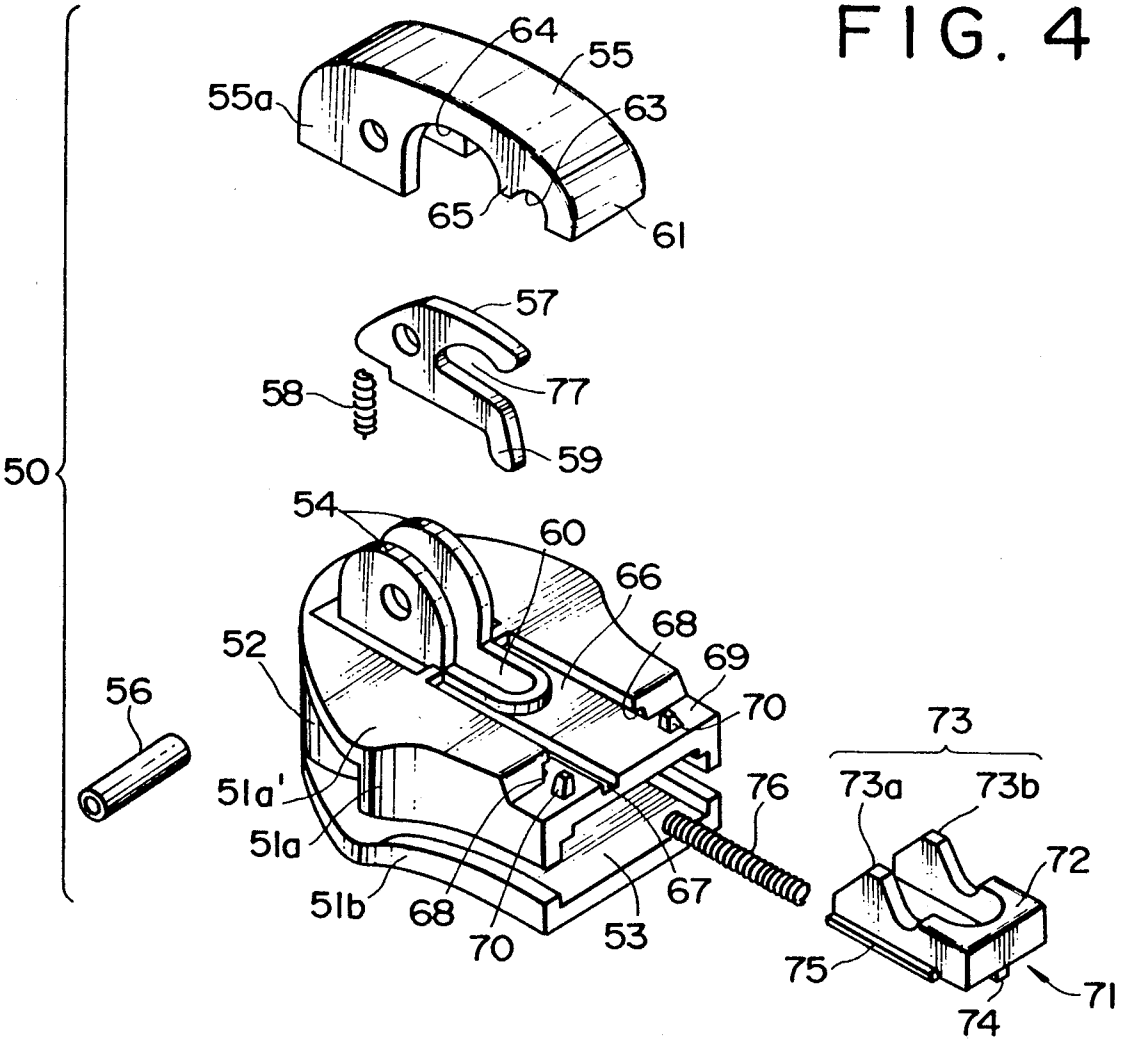
FIG. 4 is a view somewhat similar to FIG. 2 but showing an automatic locking type slider to which the provisional pull tab according to the present invention is to be attached.
Figure 5:
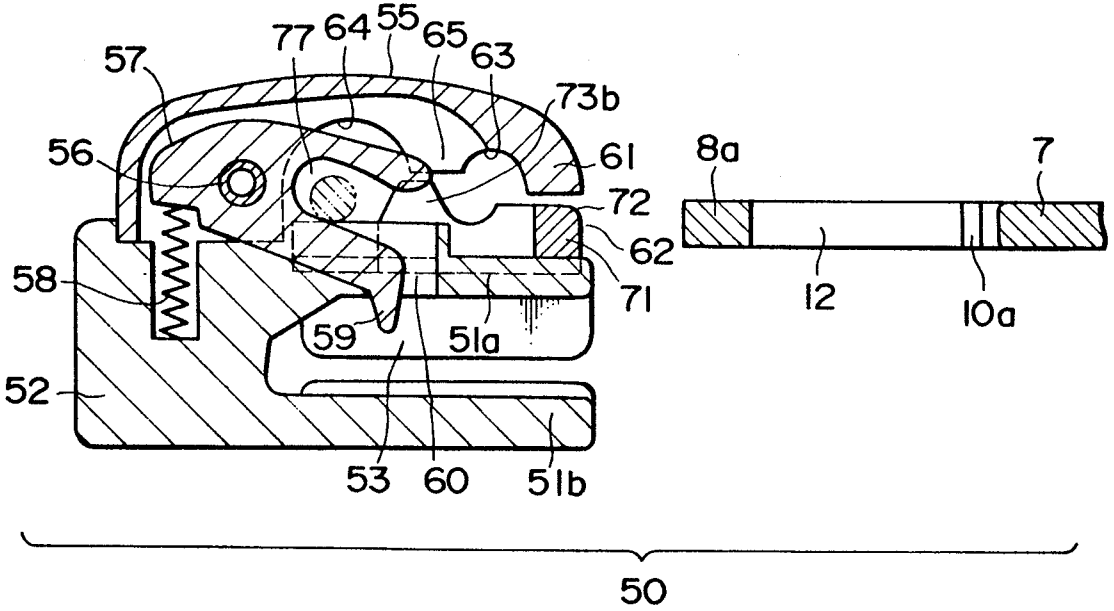
FIG. 5 is a longitudinal cross-sectional view of an automatic locking type slider of FIG. 4, showing the provisional pull tab disposed immediately before being attached to the slider.

FIGS. 4 and 5 show an automatic-locking type slider 50 to which the provisional pull tab 7 is to be attached. The slider 50 includes a slider body having upper and lower wings 51*a*, 51*b* joined at one end by a neck 52 so as to define therebetween a generally Y-shaped guide channel 53 for the passage therethrough of a pair of opposed rows of coupling elements of a slide fastener (neither shown). The slider body has a pair of spaced upstanding supports 54 integral therewith and disposed on the top surface 51*a*' of the upper wing 51*a* adjacent to the front end thereof. The slider body also includes an arch-shaped hollow lug 55 disposed over and around the supports 54 and secured at its front end 55*a* to the supports 54 by means of a tubular horizontal pin 56. A generally C-shaped locking member 57 is vertically disposed between the supports 54 and has a front end pivotally supported on the pin 56. The locking member 57 is normally urged by a compression coil spring 58 to turn clockwise about the pin 56 into its locking position shown in FIG. 5 in which a locking prong 59 projects through an aperture 60 in the upper wing 51*a* into the guide channel 53 to lock the slider 49 in position on the rows of coupling elements.

The arch-shaped hollow lug 55 has a rear free end 61 spaced from the top surface 51*a*' of the upper wing 51*a* by a predetermined gap 62 (FIG. 5) larger than the diameter of a spindle 8*a* of the provisional pull tab 7. The lug 55 has a pair of longitudinally spaced arcuate recesses 63, 64 separated by a pair of laterally spaced partition walls 65 (only one shown).

The slider body has a recessed portion 66 extending longitudinally in the top surface 51*a*' of the upper wing 51*a* from its rear end to the rear ends of the respective supports 54. The recessed portion 66 has a longitudinal guide groove 67 extending in the bottom wall of the recessed portion 66, and a pair of lateral guide grooves 68 extending in and along the opposite side walls of the recessed portion 66. The guide groove 67 is laterally displaced out of alignment with the longitudinal center line of the slider 50, as shown in FIG. 4.

The top surface 51*a*' of the upper wing 51*a* has a transverse cutout 69 extending along the rear end of the upper wing 51*a*. A pair of stopper projections 70, 70 is disposed on the cutout 69 adjacent to the rear end of the slider body. Each of the stopper projections 70 is displaced laterally outwardly from the corresponding lateral guide groove 68.

The slider body further has a generally U-shaped closure member 71 slidably mounted in the recessed portion 66 of the upper wing 51*a*. The closure member 71 has a pair of closure portions 72, 73 disposed at opposite ends thereof. The first closure portion 72 is in the shape of a flat land extending around the rear end of the closure member 71. The second closure portion 73 includes a pair of laterally spaced closure projections 73*a*, 73*b* disposed on the front end of the closure member 71. The first and second closure portions 72, 73 are spaced from one another by the distance substantially equal to the distance between the free end 61 and the partition walls 65 of the lug 55. The closure member 71 further has a longitudinal guide ridge 74 on its bottom surface, and a pair of elongated lateral guide ridges 75 (only one shown) on its opposite side surfaces. The guide ridges 74, 75 are slidably fitted in the guide grooves 67, 68, respectively. A compression coil spring 76 (FIG. 5) is disposed in the guide groove 67 and acts between the slider body and the closure member 71 to normally urge the closure member 71 toward the rear end of the slider body. The rearward movement of the closure member 71 is restricted by a pair of stops engaging the lateral guide ridges 75 on the closure member 71.

In assembly, the spring 76 and the closure member 71 are inserted in the recessed portion 66 of the upper wing 5 and then the stopper projections 70 are bent inwardly in the paths of movement of the lateral guide ridges 75 to thereby provide the respective stops. Then, after the locking member 57 is disposed between the supports 54 with the spring 58 interposed between the slider body and the front end of the locking member 57, the lug 55 is disposed over the supports 54 and the locking member 57 and then the pin 56 is threaded through the lug 55, the supports 54 and the locking member 57 to pivotably connect the locking member 57 to the supports 54 and the lug 55. In this instance, the closure member 71 is disposed in a closed position (FIG. 5) in which the first and second closure portions 72, 73 are held in vertical alignment respectively with the free end 61 and the partition walls 65 with slight spaces therebetween. Subsequently, the closure member 71 is moved forwardly from its closed position to its open position against the bias of the spring 76 by simply pushing the first closure portion or land 72 by the spindle 8*a* of the provisional pull tab 7 until the closure land 72 is brought into vertical alignment with the partition walls 65. The spindle 8*a* of the provisional pull tab 7 has now been threaded into the recess 63 adjacent to the free end 61 through the gap 62 between the free end 61 and the top surface 51*a*' of the upper wing 51*a*, whereupon the closure member 71 is returned to its closed position by the force of the spring 76. Thereafter, the provisional pull tab 7 is pushed again until the closure projection 73*a*, 73*b* are displaced forwardly by the spindle 8*a* out of vertical alignment with the partition walls 65, whereupon the spindle 8*a* is received in a rearwardly opening notch 77 in the locking member 57. Then the closure member 71 returns again to its closed position, so that the provisional pull tab 7 is now firmly retained on the slider body against accidental removal during the finishing process and inspection. It is to be noted that the constructions of the non-locking slider 11 and the automatic-locking slider 50 set forth hereinabove form no part of the present invention but only the general environment in which the present invention resides.

After the finishing process and inspection are over, the provisional pull tab 7 can be removed from the lug 15, 55 of the slider 11, 50 by simply griping and distorting the grip portion 6 and thus cutting the side rod 8*b* of the surrounding rim 8 along the notch 10*a*. This way of removing the provisional pull tab 7 is much easier and swifter than the regular way of removing a commonplace pull tab 107. The regular way would entail keeping to push the closure member 29, 71 forwardly toward the neck 13, 52 to thus provide the gap 23, 62 between the rear free end 16, 61 of the lug 15, 55 and the top surface 12*a*', 51*a*' of the upper wing 12*a*, 51*a* and concurrently pulling the pull tab 107 rearwardly or in opposite direction through the gap 23, 62 out of the slider body. The thus removed provisional pull tab 7 can be thrown away. Subsequently, such a commercial and permanent pull tab 107 is attached to the attaching lug 15, 55 of the slider 11, 50 as suit various tastes of consumers, in the same way as mentioned hereinabove.

Figure 6:
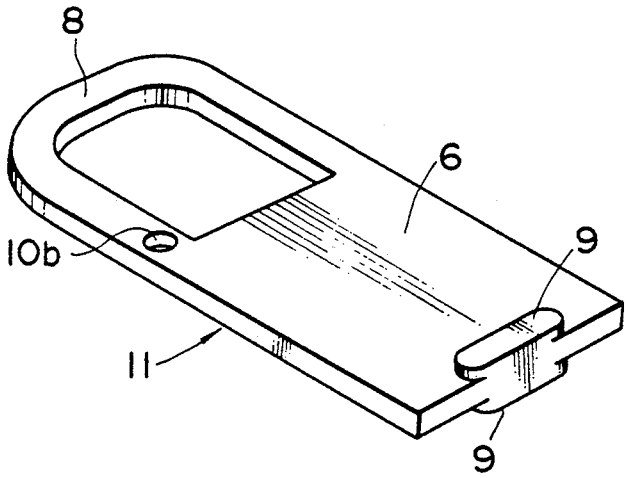
FIG. 6 is a perspective view of a provisional pull tab according to the second embodiment of the present invention.

FIG. 6 shows the second embodiment of the present invention, wherein, instead of the notch 10*a*, a through hole 10*b* is formed through one of the side rods 8*b*, 8*b* of the surrounding rim 8 adjacent its proximal end so as to form a fragile portion there.

Figure 7:
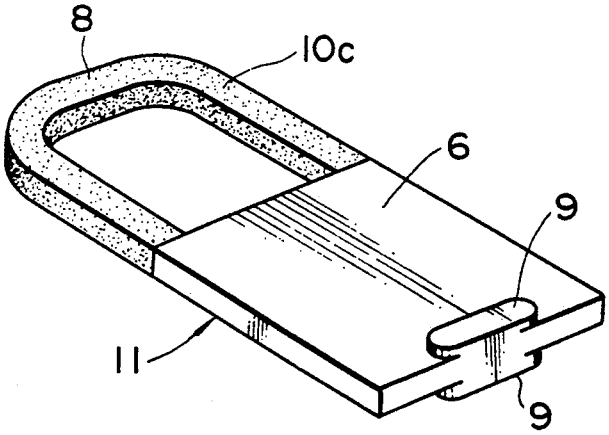
FIG. 7 is a perspective view of a provisional pull tab according to the third embodiment of the present invention.
Figure 8:
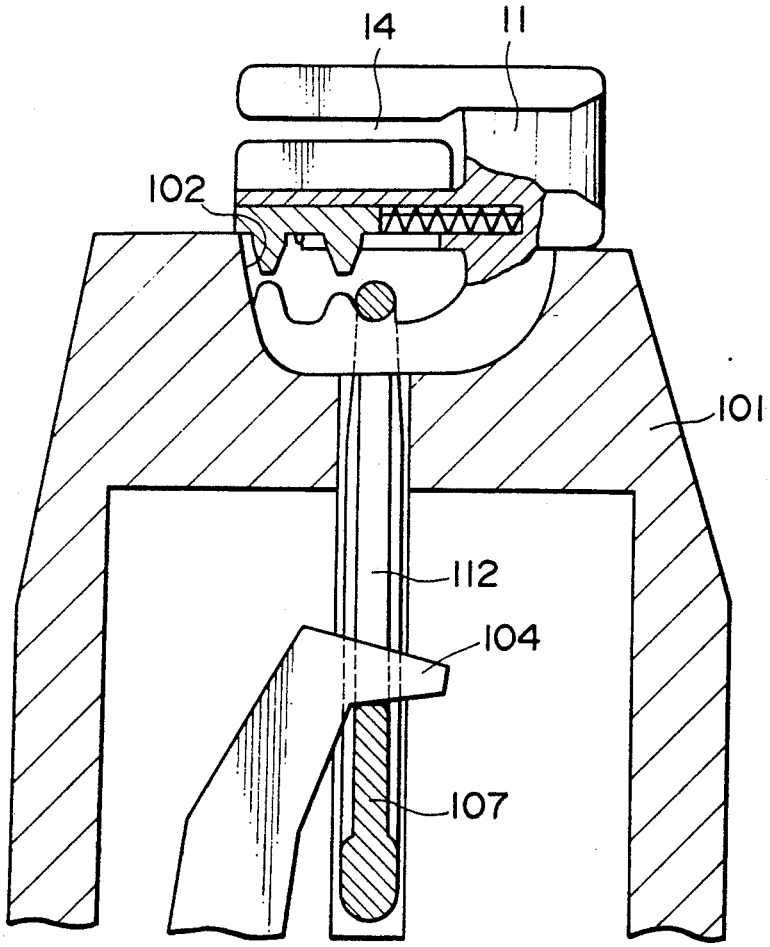
FIG. 8 is a longitudinal cross-sectional view showing the non-locking type slider of FIG. 2 mounted on a slider holder during a stringer-threading process.
Figure 9:
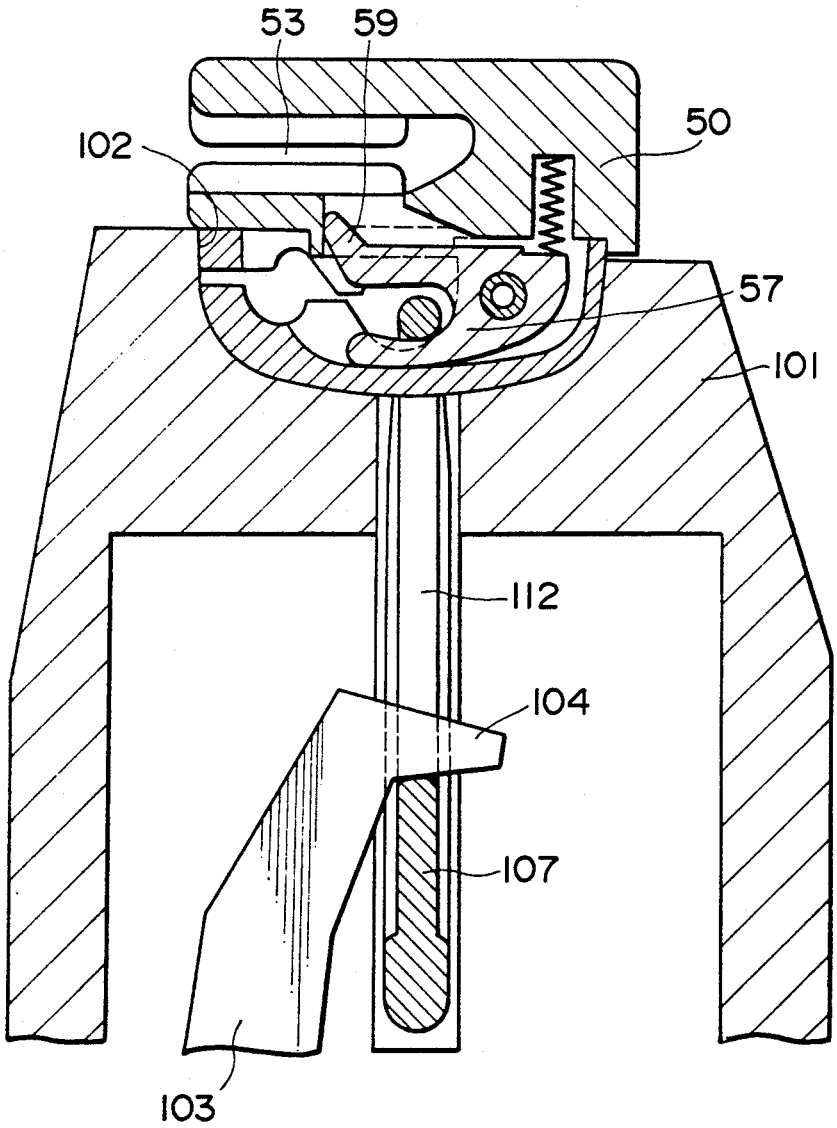
FIG. 9 is a view similar to FIG. 8 but showing the automatic locking type slider of FIG. 4 mounted on the slider holder.

FIG. 7 shows the third embodiment of the present invention, wherein the whole surrounding rim 8 is made of a material 10*c* which is more brittle than the material of the grip portion 6. The mechanical strength of the surrounding rim 8 is, however, such that the surrounding rim 8 can sufficiently endure tension imparted by the detent 122 during the stringer-threading operation and stresses exerted by the opening and closing operation of the slider 11, 50.

It is to be noted that the position and shape of the notch 10*a* and the through hole 10*b* are not limited to those illustrated in the drawings and any suitable shape and positions may be selected.

With the construction of the present invention described hereinabove, the provisional pull tab 7 can accomplish the functions required during the stringer-threading step and inspection.

Furthermore, on or after buying garments or baggages with sliders carrying the provisional pull tabs, advantageously, consumers can easily remove the provisional pull tabs and substitute therefor commercial pull tabs which suit their own tastes.

Still furthermore, since, during the finishing process and the following delivery, sliders carrying the provisional pull tabs instead of commercial pull tabs are handled, then, they can advantageously handle the sliders more conveniently with less care.

The size of the aperture 12 in the surrounding rim 8 is such that, during the stringer-threading step, the detent 104 can be inserted therethrough reliably and smoothly.

Obviously, various modifications and variations of the present invention are possible in the light of the above teaching. It is therefore to be understood that within the scope of the appended claims the invention may be practiced otherwise than as specifically described.

What is claimed is:

1. In a slider for slide fasteners including a slider body having a lug on its upper surface; a provisional pull tab releasably mounted on the slider body and comprising a grip portion adapted for being gripped and pulled for manipulation of the slider; a surrounding rim integrally extending from the grip portion and defining with a proximal end of the grip portion an aperture, through which the lug is inserted so that the provisional pull tab is pivotally mounted on the lug; and a fragile portion disposed at least partially around the aperture to thus permit a breaking open of the aperture for detaching the provisional pull tab from the slider body.

2. A provisional pull tab according to claim 1, the fragile portion comprising a notch cut in the surrounding rim.

3. A provisional pull tab according to claim 1, the fragile portion comprising a through hole formed through the surrounding rim.

4. A provisional pull tab according to claim 1, the fragile portion comprising a surrounding rim made of a material more brittle than the material of the grip portion.

5. A provisional pull tab according to claim 1, the grip portion having a pair of projections, one mounted on either surface thereof on its distal end.

6. A provisional pull tab according to claim 1, wherein the fragile portion is formed in the surrounding rim at a proximal end of the surrounding rim.

7. A provisional pull tab according to claim 6, wherein the fragile portion comprises a notch cut in the surrounding rim.

8. A provisional pull tab according to claim 6, wherein the fragile portion comprises a through hole formed through the surrounding rim.

* * * * *